US012179307B2

(12) United States Patent
Larson et al.

(10) Patent No.: US 12,179,307 B2
(45) Date of Patent: Dec. 31, 2024

(54) MASKING TOOL SYSTEM AND METHOD

(71) Applicant: Bell Textron Inc., Fort Worth, TX (US)

(72) Inventors: Michael Scott Lee Larson, Fort Worth, TX (US); Roland L. Walker, Jr., Arlington, TX (US); Mark Philip Vance, Fort Worth, TX (US); James Joseph Meyer, Slidell, TX (US); Edward P. Michaels, Jr., Arlington, TX (US)

(73) Assignee: Textron Innovations Inc., Providence, RI (US)

( * ) Notice: Subject to any disclaimer, the term of this patent is extended or adjusted under 35 U.S.C. 154(b) by 1122 days.

(21) Appl. No.: 17/063,989

(22) Filed: Oct. 6, 2020

(65) Prior Publication Data

US 2021/0016414 A1 Jan. 21, 2021

Related U.S. Application Data

(62) Division of application No. 15/952,405, filed on Apr. 13, 2018, now Pat. No. 10,792,781.

(51) Int. Cl.
*B24B 1/04* (2006.01)
*B24B 31/00* (2006.01)
(Continued)

(52) U.S. Cl.
CPC ..... *B24B 35/005* (2013.01); *B24B 1/04* (2013.01); *B24B 31/003* (2013.01); *B24B 31/0224* (2013.01); *B24B 31/108* (2013.01)

(58) Field of Classification Search
CPC ..... B24B 1/04; B24B 31/00; B24B 31/003; B24B 31/02; B24B 31/0224;
(Continued)

(56) References Cited

U.S. PATENT DOCUMENTS 647,708 A * 4/1900 Schwager
953,450 A * 3/1910 Hanbury ..... B24B 31/02 451/328
(Continued)

FOREIGN PATENT DOCUMENTS

CA 2433298 A1 7/2002
CN 204842345 U 12/2015
(Continued)

OTHER PUBLICATIONS

REM Surface Engineering, "Rapid ISF," published Aug. 23, 2012, YouTube video, URL: <https://www.youtube.com/watch?v=B8hpJcJxldl&feature=youtu.be&t=41>, Retrieved: Apr. 9, 2018.
(Continued)

*Primary Examiner* — Eileen P Morgan
(74) *Attorney, Agent, or Firm* — Bradley Arant Boult Cummings LLP

(57) ABSTRACT

A masking tool system includes a first masking body and a second masking body. The first masking body includes a bore passing through a portion of the first masking body and a first sealing element disposed on a first end of the first masking body. The second masking body includes a bore passing through the second masking body and a second sealing element disposed on a first end of the second masking body. The system may also include a rod configured to pass through the bores of the first and second masking bodies and to secure the first and second masking bodies to a metallic article placed therebetween. A diagonal length of the masking tool system induces a wobbling rotation during processing.

16 Claims, 13 Drawing Sheets

(51) Int. Cl.

| | |
|---|---|
| ***B24B 31/02*** | (2006.01) |
| ***B24B 31/06*** | (2006.01) |
| ***B24B 31/108*** | (2006.01) |
| ***B24B 35/00*** | (2006.01) |

(58) Field of Classification Search
CPC ..... B24B 31/027; B24B 31/06; B24B 31/064; B24B 31/108; B24B 35/005
USPC ..... 451/29, 32, 35, 74, 113, 326, 327, 328
See application file for complete search history.

(56) References Cited

U.S. PATENT DOCUMENTS

| | | | | |
|---|---|---|---|---|
| 2,843,979 | A * | 7/1958 | Lupo | B24B 31/02 451/328 |
| 3,423,884 | A * | 1/1969 | Balz | B24B 31/073 451/327 |
| 3,482,423 | A | 12/1969 | Murray et al. | |
| 4,385,472 | A * | 5/1983 | Balz | B24B 31/108 451/326 |
| 4,491,500 | A | 1/1985 | Michaud et al. | |
| 4,705,594 | A | 11/1987 | Zobbi et al. | |
| 4,818,333 | A | 4/1989 | Michaud | |
| 4,906,327 | A | 3/1990 | Michaud et al. | |
| 5,051,141 | A | 9/1991 | Michaud et al. | |
| 5,158,623 | A | 10/1992 | Michaud et al. | |
| 5,158,629 | A | 10/1992 | Zobbi | |
| 5,464,477 | A | 11/1995 | Awad | |
| 5,503,481 | A | 4/1996 | Hashimoto et al. | |
| 6,019,852 | A | 2/2000 | Pedziwiatr et al. | |
| 6,361,610 | B1 | 3/2002 | Scotto et al. | |
| 7,066,799 | B2 | 6/2006 | Oussaada et al. | |
| 7,641,744 | B2 | 1/2010 | Winkelmann | |
| 8,105,133 | B2 | 1/2012 | Jayabalan | |
| 8,858,734 | B2 | 10/2014 | Michaud et al. | |
| 9,032,619 | B2 * | 5/2015 | Korn | F01D 5/005 29/889.1 |
| 9,057,272 | B2 * | 6/2015 | Cheah | B24B 31/06 |
| 2002/0028631 | A1 * | 3/2002 | Nishiuchi | C23C 14/505 451/326 |
| 2002/0106978 | A1 | 8/2002 | Michaud et al. | |
| 2005/0014597 | A1 | 1/2005 | Michaud et al. | |
| 2006/0207093 | A1 | 9/2006 | Bend | |
| 2008/0129146 | A1 | 6/2008 | Puskas | |
| 2009/0282677 | A1 * | 11/2009 | Korn | F04D 29/644 29/889.1 |
| 2010/0288398 | A1 | 11/2010 | Sroka et al. | |
| 2011/0117820 | A1 * | 5/2011 | Sroka | B24B 41/06 451/36 |
| 2013/0323071 | A1 * | 12/2013 | Boon Beng | B24B 31/003 451/364 |
| 2014/0003951 | A1 | 1/2014 | Soucy et al. | |
| 2014/0003952 | A1 * | 1/2014 | Cheah | B24B 31/06 451/442 |
| 2015/0000701 | A1 | 1/2015 | Tevely et al. | |
| 2016/0159392 | A1 | 6/2016 | Hoffmann | |
| 2017/0173755 | A1 * | 6/2017 | Choo | B24B 31/073 |
| 2019/0314949 | A1 | 10/2019 | Larson et al. | |

FOREIGN PATENT DOCUMENTS

| | | | | |
|---|---|---|---|---|
| EP | 0657658 | A1 | 6/1995 | |
| WO | WO-2013180944 | A1 * | 12/2013 | B24B 31/003 |

OTHER PUBLICATIONS

REM Surface Engineering, "REM ISF (Isotropic Superfinish) Process Overview," published Jun. 1, 2012, YouTube video, URL: <https://www.youtube.com/watch?v=M6FxilBXNhg>, Retrieved: Apr. 9, 2018.

ArrowGearMedia, "Arrow Gear: REM Isotropic Superfinishing Systems, " published Mar. 14, 2013 , YouTube video, URL: <https://www.youtube.com/watch?v=hugAWWZaz4Q&feature=youtu.be&t=30>, Retrieved: Apr. 9, 2018.

Larson, Michael Scott Lee, et al.; "Method of Identifying and Removing Aggregate"; U.S. Appl. No. 16/671,868, filed Nov. 1, 2019; 38 pages.

* cited by examiner

MASKING TOOL SYSTEM AND METHOD

CROSS-REFERENCE TO RELATED APPLICATIONS

This application is a divisional of U.S. patent application Ser. No. 15/952,405, filed Apr. 13, 2018, the contents of which are incorporated by reference in their entirety herein for all purposes.

BACKGROUND

This section provides background information to facilitate a better understanding of the various aspects of the disclosure. It should be understood that the statements in this section of this document are to be read in this light, and not as admissions of prior art.

Surfaces of metallic articles are often polished to improve one or more of mechanical performance, wear characteristics, and appearance. Polishing of metallic articles is often done using a mechanically abrasive process such as machining or grinding. Some metallic articles can be difficult to polish using machining and grinding processes. For example, metallic articles with complex surfaces can be challenging to polish via machining or grinding.

SUMMARY

An example masking tool system includes a first masking body and a second masking body. The first masking body includes a bore passing through a portion the first masking body and a first sealing element disposed on a first end of the first masking body. The second masking body includes a bore passing through the second masking body and a second sealing element disposed on a first end of the second masking body. The system also includes a rod configured to pass through the bores of the first and second masking bodies and to secure the first and second masking bodies to a metallic article placed therebetween.

An example masking tool system includes a first end body and a second end body. The first end body includes a bore passing through the first end body and a sealing element disposed on a first end of the first end body. The second end body includes a bore passing through the second end body and a second sealing element disposed on a first end of the second body. The system also includes a first endcap and a second endcap. The first endcap is configured to couple to the first end body and includes a third sealing element configured to provide a seal between the first endcap and the first end body. The second endcap is configured to couple to the second end body and includes a fourth sealing element configured to provide a seal between the second endcap and the second end body. The system further includes a rod configured to pass through the bores of the first and second end bodies and to secure the first and second end bodies to a metallic article placed therebetween.

An example of a method of applying an isotropic superfinish to a portion of a metallic article includes masking a portion of the metallic article with a masking tool system, the masking tool comprising a diagonal length, and placing the masking tool system into a pocket defined by adjacent baffles within a bowl of an isotropic superfinish system. Each of the adjacent baffles includes a midpoint along a radial length of the baffle that defines a midpoint distance between the adjacent baffles. The diagonal length is greater than the midpoint distance between the midpoints of the adjacent baffles and the masking tool system moves within the pocket with a wobbling rotational movement during processing of the metallic article by the isotropic superfinish system.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
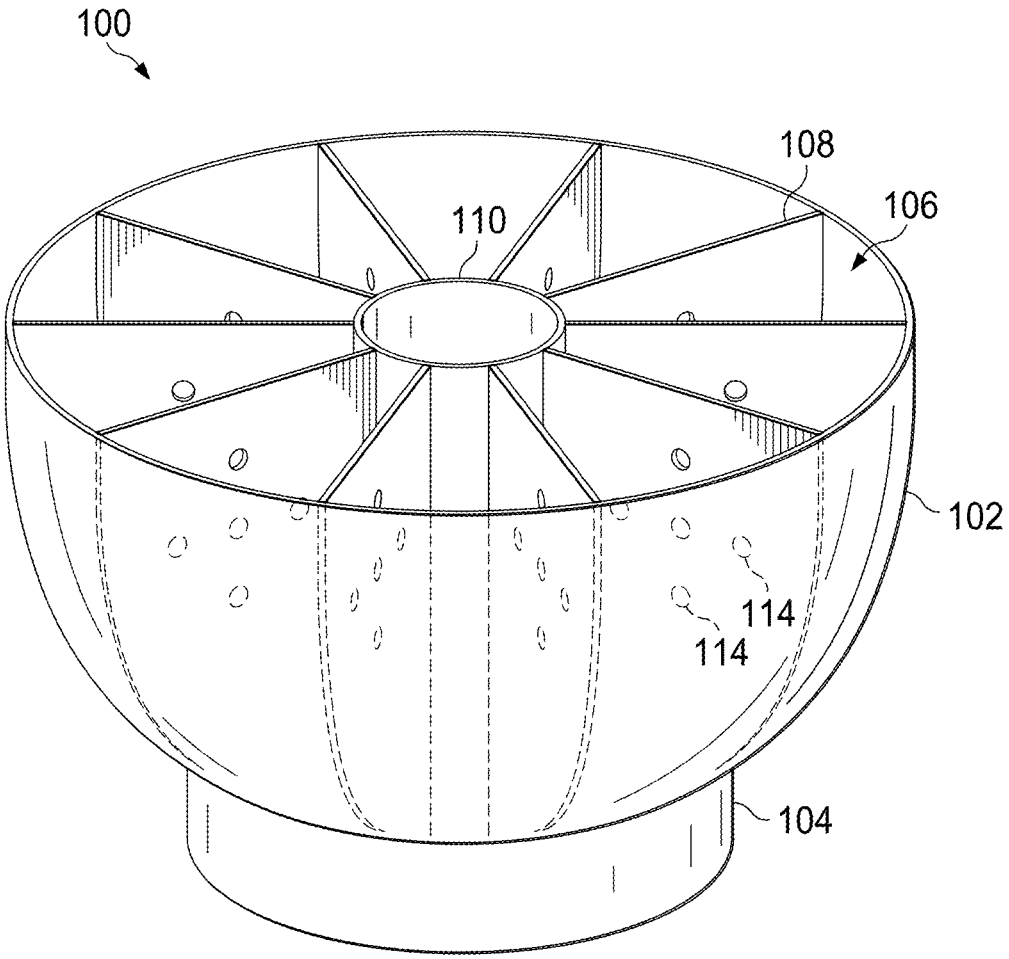
FIG. 1 illustrates a partial hidden view of an exemplary isotropic superfinish system for applying an isotropic superfinish to a metallic article.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

In the specification, reference may be made to the spatial relationships between various components and to the spatial orientation of various aspects of components as the devices are depicted in the attached drawings. However, as will be recognized by those skilled in the art after a complete reading of the present disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Surfaces of metallic articles, such as components of machinery, are often treated to help prevent wear, cracks, and other defects. Traditional surface treatments often include abrasive techniques such as machining or grinding that result in machining lines or swirls being formed on a surface that is treated. There are a variety of metal articles that include critical working surfaces for which the machining lines/swirls can be problematic. For example, some metallic articles that include critical working surfaces include portions of splines, crankshafts, camshafts, bearings, gears, couplings, and journals. For these metallic articles, machining lines or swirls formed on the critical working surfaces can cause poor surface contact performance due to, for example, increased friction, torque, noise, vibration, and operating temperature. The machining line/swirls can also result in impaired lubricity and failure from wear, scuffing, plastic deformation, contact fatigue, and bending fatigue. For gears or other parts placed in a demanding environment such as the drivetrain of machines, vehicles, and the like, resistance to these types of failures and defects can, in effect, define the useful life of the metallic article.

Critical working surfaces (including recessed areas) have conventionally been refined through various machine grinding/polishing processes. But those processes can have multiple drawbacks. For complex shapes (e.g., gear teeth, adjacent features, and the like), machine grinding tools are very expensive, require skilled operators, and undergo excessive wear, and may have machinability issues. Furthermore, machining and grinding are typically carried out on a part-by-part basis and feature-by-feature basis, as such, are plagued with problems of repeatability and uniformity.

In order improve the surface finish or appearance created by traditional machining and grinding processes, alternative surface treatments are available. One such treatment is known as an isotropic superfinish process. The isotropic superfinish process refines surfaces of metallic articles for mechanical improvement and/or cosmetic purposes so that the surface of those articles is isotropic and superfinished. Treating metallic articles with the isotropic superfinish process results in surfaces having improved wear characteristics compared to machining and grinding processes and that are also less susceptible to crack formation and propagation.

Figure 2:
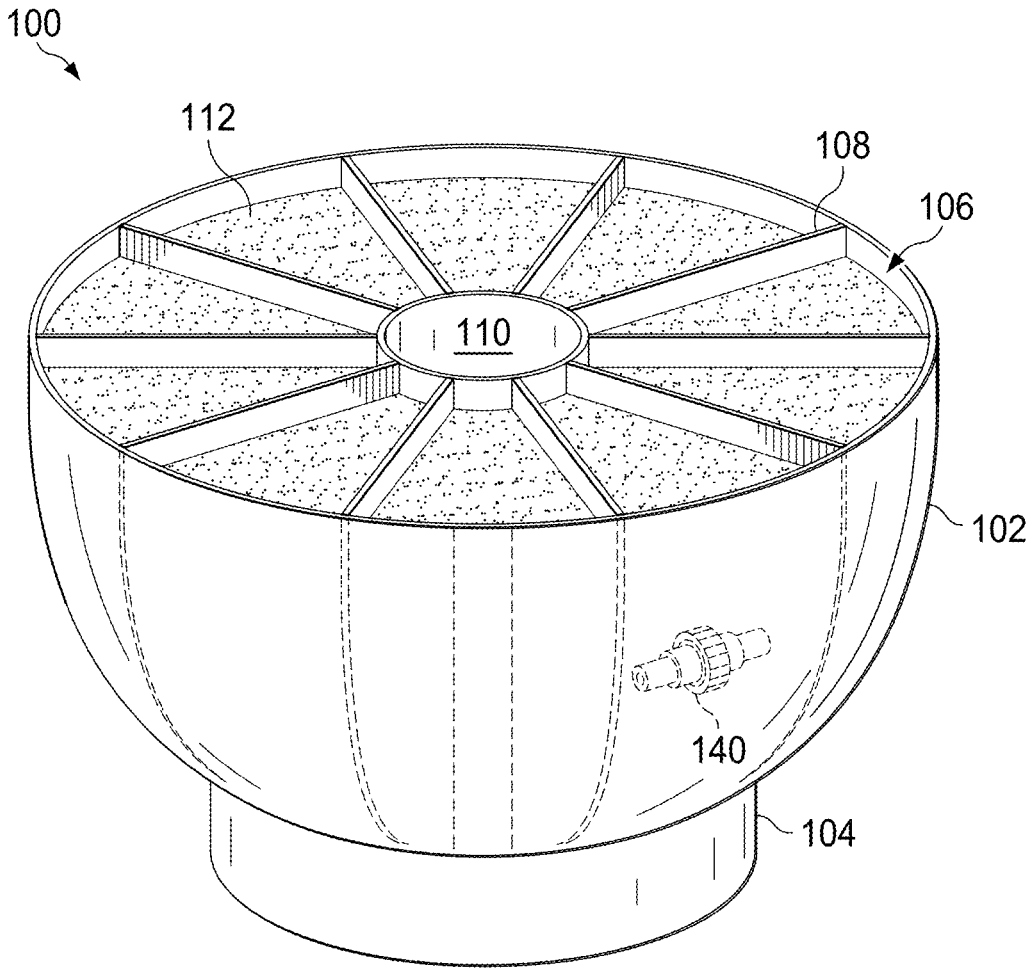
FIG. 2 illustrates a partial hidden view of the isotropic superfinish system of FIG. 1 with a metallic article placed therein for treatment.
Figure 3:
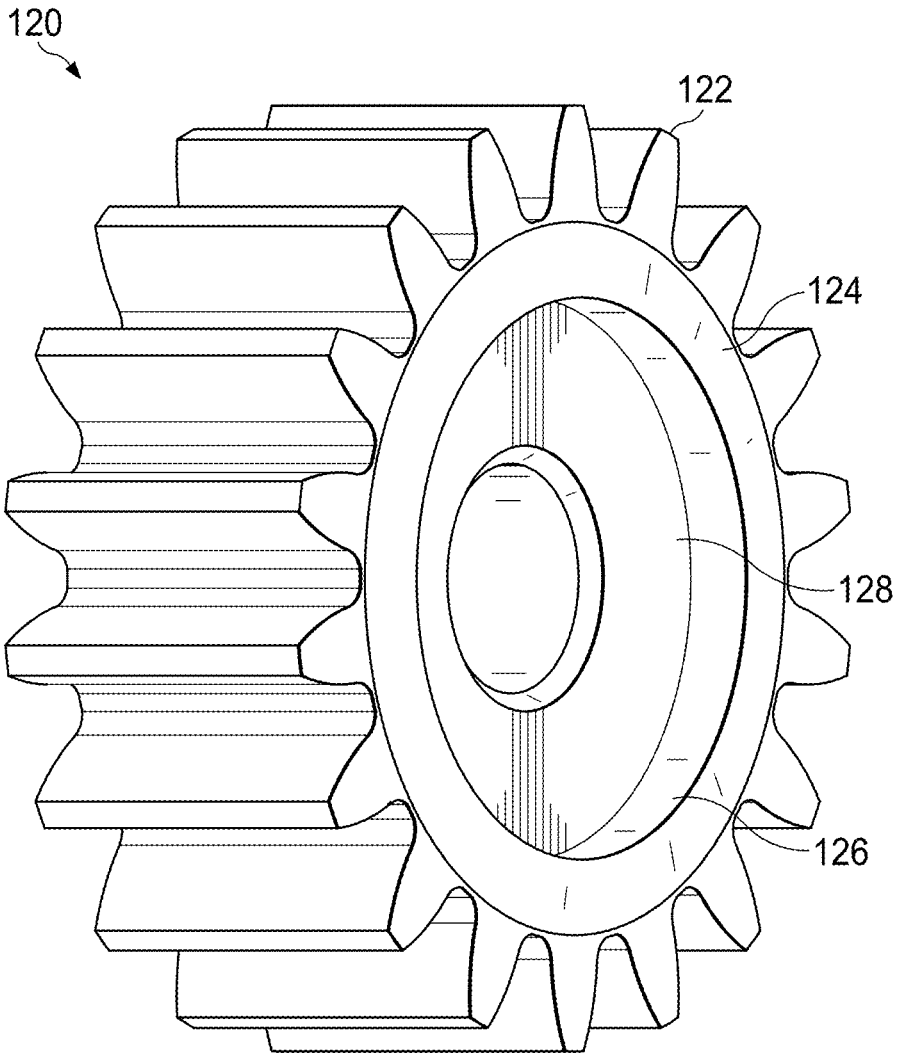
FIG. 3 illustrates a metallic article to which an isotropic superfinish process may be applied.

FIGS. 1 and 2 illustrate an isotropic superfinish system 100 for applying an isotropic superfinish to a metallic article 120. In some isotropic superfinish processes, metallic articles are placed into a bowl 102 for processing. FIG. 1 illustrates the isotropic superfinish system 100 in partial hidden view to show some of the structure within the bowl 102. FIG. 2 illustrates the isotropic superfinish system 100 in partial hidden view to show a masking tool system 140 placed into the isotropic superfinish system 100 for treatment. The masking tool system 140 is discussed in more detail below. The bowl 102 sits on a base 104. In an exemplary embodiment, a bottom of the bowl is shaped like half of a toroid with a circular radius bottom. The circular radius bottom may help induce a wobbling rotation when a diagonal length of masking tool is of a certain dimension. The wobbling rotation and diagonal length will be discussed in more detail below. In other embodiments, the bottom of the bowl 102 may have other shapes. By way of example, FIG. 3 illustrates the metallic article 120 in the form of a gear. In various embodiments, the metallic article 120 may comprise one or more of a gear, spline, crankshaft, camshaft, bearing, bearing surface, coupling, shaft, and journal. Dimensions and form of the metallic article 120 may vary.

An interior of the bowl 102 may be divided into a plurality of pockets 106 by a plurality of baffles 108 that are spaced equally about the bowl 102. As shown in FIGS. 1 and 2, the plurality of pockets 106 are wedge shaped. In other embodiments, more or fewer baffles 108 may be used to form more or fewer pockets 106. In some embodiments, one or more baffles 108 may be removed to create pockets 106 of different sizes. The plurality of baffles 108 help separate multiple metallic articles 120 from each other so that multiple metallic articles 120 may be placed into the bowl 102 for treatment without touching one another. During operation of the isotropic superfinish system 100 of FIG. 1, an aggregate 112 is placed into the bowl 102 (see FIG. 2). The aggregate 112 rotates slowly about a central portion 110 of the bowl 102 due to the vibratory forces imposed on the aggregate 112. As the aggregate 112 moves around the bowl 102, the metallic article 120 moves with the aggregate 112 and is stirred around the bowl 102. The base 104 and/or the central portion 110 may include components configured to provide vibratory forces to the bowl 102 and contents of the bowl 102. In an exemplary embodiment, the aggregate 112, along with the plurality of baffles 108, rotates in a counterclockwise direction. In other embodiments, the aggregate 112 and the plurality of baffles 108 may rotate in a clockwise direction.

The aggregate 112 is typically comprised of multiple components. For example, the aggregate 112 may comprise one or more ceramic media and/or optionally one or more plastic media. In various embodiments, to ensure that aggregate 112 does not get lodged in features such as holes, grind reliefs, overhangs, crevices and the like of the masking tool system 140, the masking tool system 140 should not include features that could allow the aggregate 112 to become stuck or lodged therein. In some embodiments, components of the masking tool system 140 do not include exposed areas or features that are larger than 0.020 inches or smaller than 1.037 inches to prevent components of the aggregate 112 from getting caught in or stuck on the masking tool system 140. Similarly, the masking tool system 140 should not include dimensions or features that would impede the flow of aggregate 112 to a surface of the metallic article 120 that is to receive an isotropic superfinish treatment. To improve the flow of aggregate 112 to such surfaces of the metallic article 120, components of the masking tool system 140 may be rounded, bevelled, angled, stepped, and the like to provide an easier path for the aggregate 112 to flow around the metallic article 120. For example, if the metallic article 120 is a pinion gear, it may be desirable to have an angled or bevelled portion. If the metallic article 120 comprises an end portion that has a very small diameter, it may be desirable to have an angled or bevelled portion that transitions from the small diameter of the metallic article 120 to the larger end diameter of the masking tool.

Each baffle 108 includes a plurality of holes 114 through which some of the aggregate 112 may pass as the plurality of baffles 108 rotate about the bowl 102. To allow the aggregate 112 to pass through the plurality of holes 114 without clogging the plurality of holes 114, each hole 114 has a diameter that is several times larger than a diameter of the largest component of the aggregate 112. The stirring action of the aggregate 112 and the plurality of baffles 108 helps to cause the metallic article 120 to move about within the aggregate 112 to cause surfaces of the metallic article 120 to come into contact with the aggregate 112 so that the surfaces of the metallic article 120 receive an isotropic superfinish.

In order to apply an isotropic superfinish to a surface of the metallic article 120, the metallic article 120 is placed into the bowl 102. A vibratory force is applied to the bowl 102 by the base 104. The vibratory force is transmitted from the bowl 102 to the aggregate 112 and the metallic article 120. In an exemplary embodiment, a chemical solution is supplied periodically to the bowl 102 during application of the vibratory force. The chemical solution may be sprayed into the bowl 102 by one or more sprayers that are positioned proximate the bowl 102. For example, the one or more sprayers may be secured to the central portion 110. The chemical solution is chosen to be mildly reactive with the metallic article 120. When the chemical solution comes into contact with the metallic article 120 it forms a reaction product on exposed surfaces of the metallic article 120. Over time, the vibration of the aggregate against the metallic article 120 removes the reaction product and polishes the surface to create an isotropic superfinish.

The above isotropic superfinish process can be used to apply surface treatments to a wide range of metallic articles. In practice, it has been found that some metallic articles require additional processing in the bowl in order to obtain a desired level of isotropic superfinish. The instant application identifies certain problems that can result in applying isotropic superfinish to metallic articles to obtain a desired level of isotropic superfinish uniformly and presents solutions to those problems.

FIG. 3 illustrates an embodiment of the metallic article 120. By way of example, the metallic article 120 is shown in FIG. 3 as a gear. In other embodiments, the metallic article 120 could be another metallic component, such as a spline, crankshaft, camshaft, bearing, bearing surface, coupling, shaft, journal, and the like. The metallic article 120 includes teeth 122, a side face 124, an inner wall 126, and a recessed side face 128. The metallic article 120 of FIG. 3 is symmetrical and includes a side face 125, an inner wall 127, and a recessed side face 129 (best seen in FIGS. 8 and 9). In some applications, it may be desirable to apply the isotropic superfinish to a portion of the metallic article 120. For example, it may be desired to only apply the isotropic superfinish to the teeth 122, the side face 124, and the side face 125. In order to do that, a masking tool can be used to cover the surfaces to which no isotropic superfinish is to be applied.

Figure 4:
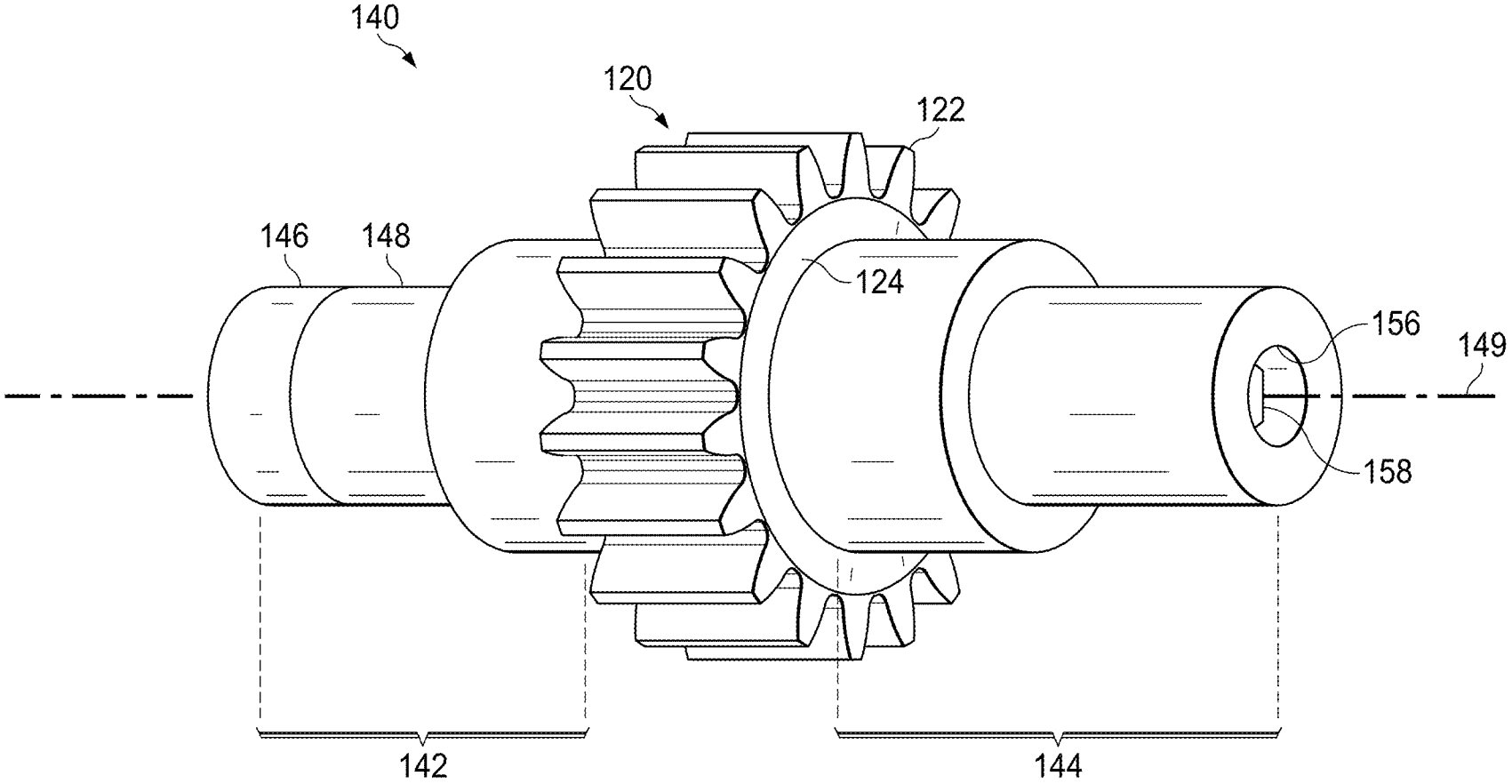
FIG. 4 illustrates an exemplary masking tool system.
Figure 5:
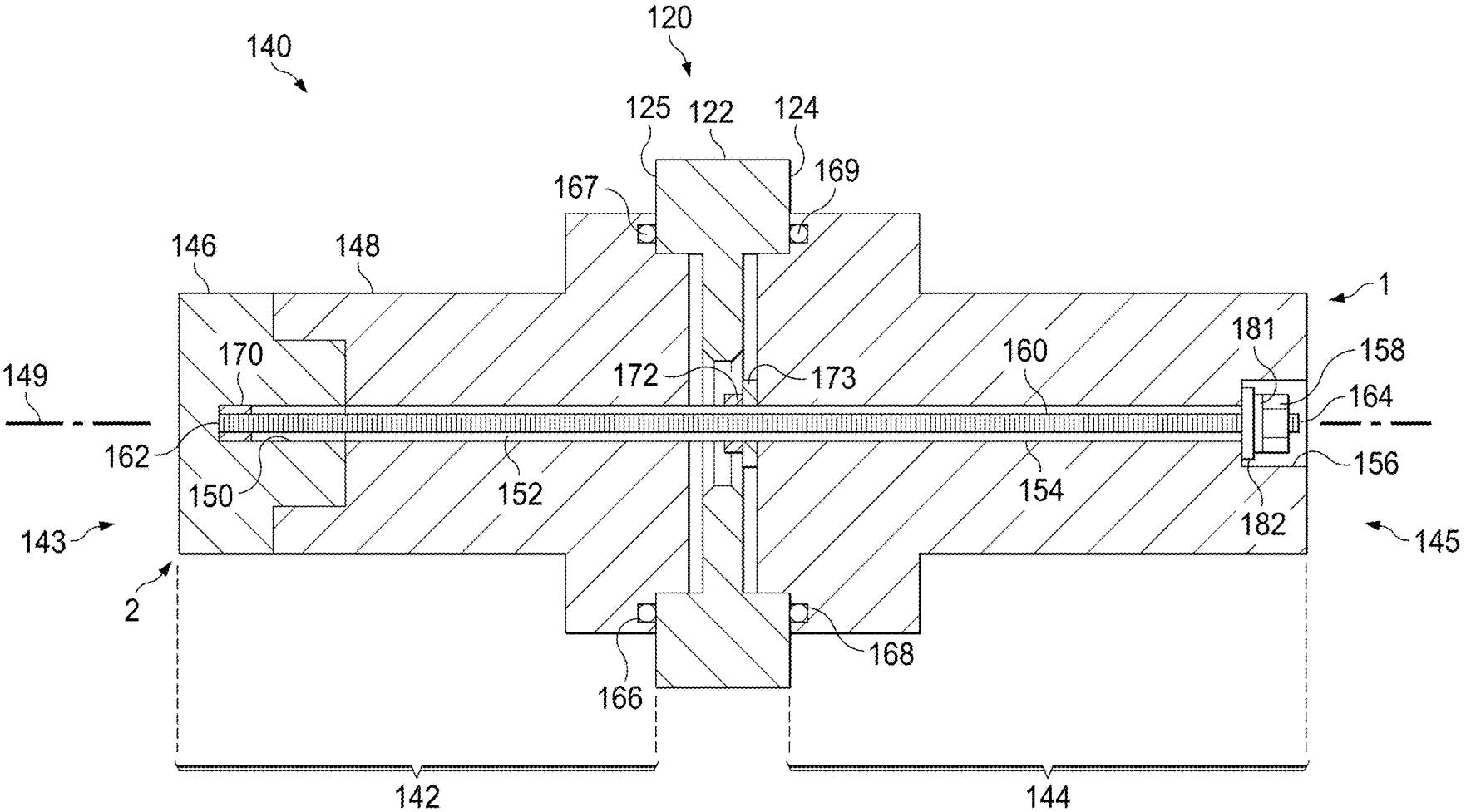
FIG. 5 is a cross-sectional side view of the masking tool system of FIG. 4.

Referring now to FIGS. 4 and 5, a masking tool system 140 for use with the isotropic superfinish system 100 is shown. FIG. 4 is an isometric view of the masking tool system 140 and FIG. 5 is a cross-sectional side view of the masking tool system 140. The masking tool system 140 masks a portion of the metallic article 120 so that only an unmasked portion of the metallic article 120 is exposed for treatment by the isotropic superfinish system 100. As shown in FIGS. 4 and 5, the unmasked portion of the metallic article 120 includes the teeth 122 and portions of the side faces 124, 125. The remaining portions of the metallic article 120 are masked by the masking tool system 140 and do not receive an isotropic superfinish.

The masking tool system 140 includes a first masking body 142 and a second masking body 144 that are coupled to opposing sides of the metallic article 120. In FIGS. 4 and 5, the metallic article 120 is illustrated as a gear. It should be understood that the metallic article 120 may be any of a variety of components, such as a gear, spline, crankshaft, camshaft, bearing, coupling, shaft, journal, and the like. To accommodate different metallic articles 120, different first and second masking bodies 142, 144 with dimensions corresponding to the different metallic article 120 are used to mate up with the metallic article 120 to mask of the desired portion of the metallic article. The discussion below of the metallic article 120 is illustrative.

The first masking body 142 includes an endcap 146 and a main body 148. A bore 150 passes through a portion of the endcap 146 and a bore 152 passes through the main body 148. The second masking body 144 includes a bore 154 that aligns with the bores 150, 152 when the first and second masking bodies 142, 144 are attached to the metallic article 120. The second masking body 144 also includes a bore 156 that acts as a recess to receive a nut 158. Each of the bores 150, 152, 154, and 156 are centered about a central axis 149. Recessing the nut 158 permits the masking tool system 140 to more freely move within the bowl 102 during processing. For example, if the nut 158 is not recessed, the nut 158 can become lodged against an edge of one of the holes 114. If the nut 158 becomes lodged, the masking tool system 140 does not freely move within the bowl 102, which ultimately results in the metallic article 120 receiving an inconsistent or low quality isotropic superfinish. Furthermore, if the nut 158 is not recessed, the nut 158 can scrape and gouge the bowl 102 and the plurality of baffles 108. Movement of the masking tool system 140 is discussed in more detail below relative to FIG. 9.

As shown in FIG. 5, the first masking body 142 and the second masking body 144 are held together against the metallic article 120 by a rod 160. The rod 160 has a first rod end 162 that is secured to the first masking body 142 and a second rod end 164 to which the nut 158 can fasten. In an exemplary embodiment, the rod 160 is an all-thread rod made of heat-treated material for improved strength. It has been determined that some rod materials, such as those materials having a proof load of lower than 85,000 in-lbs, tend to strip threads, bend, and/or break as a result of repeated use. Using a material with a higher proof load, such as SAE J429 Grade 5 or higher, improves the strength of the rod 160 to provide a longer service life. The first rod end 162 is secured to the first masking body 142 by threading the rod into an insert 170 that is installed into the endcap 146. In a different embodiment, the bore 156 and nut 158 could be replaced with an insert similar to the insert 170 (e.g., similar to the embodiment shown in FIG. 7). Replacing the bore 156 and the nut 158 with an insert removes a potential leak point from the masking tool system 140. The first and second masking bodies 142, 144 may be tightly secured to the metallic article 120 by tightening the endcap 146. In some embodiments, the endcap 146 includes a surface texture, such as a diamond knurl pattern, to improve gripability of the endcap 146.

The masking tool system 140 may include one or more sealing elements to prevent the chemical solution and the aggregate 112 from entering an interior of the masking tool system 140. As shown in FIG. 5, the first masking body 142 includes an o-ring gland 166 that is configured to hold an o-ring 167 and the second masking body 144 includes an o-ring gland 168 that is configured to hold an o-ring 169. With the endcap 146 fastened to the rod 160, the o-rings 167, 169 press against the side faces 125, 124, respectively, to form a seal that prevents the chemical solution and the aggregate 112 from contacting the masked portion of the metallic article 120. As a result, only the teeth 122 and the exposed portions of the side faces 124, 125 contact the aggregate 112 and the chemical solution to receive an isotropic superfinish.

The o-rings 167, 169 may be made of various materials, but the material selected should be non-reactive with the chemical solution used in the isotropic superfinish process. In an exemplary embodiment, the o-rings 167, 169 are made of an FKM rubber, such as, for example, VITON®. Other o-ring materials such as nitrile butadiene rubber (NBR) can react with the chemical solution used in the isotropic superfinish process. As a result, the useful life of NBR-based o-rings is shorter as compared to FKM-based o-rings.

It has been determined that o-ring performance is improved by dimensioning the o-ring glands 166, 168 to have widths that are out of the standard ranges specified by the Parker O-ring Handbook. For liquid face seals, the Parker O-ring Handbook specifies a nominal gland width increasing from 128%-149% of O-ring nominal cross section with an incrementing tolerance. For Gas/Vacuum face seals, the Parker O-ring Handbook specifies widths of 114%-127% with a ±0.0025" tolerance. In contrast to the Parker Handbook specifications, the o-ring glands 166, 168 are dimensioned to have a width of about 87% to about 101% of a cross-section of the o-rings 167, 169, respectively. Compared to the Parker O-ring Handbook dimensions, using the 87%-101% o-ring gland dimensions, an improved seal between the o-rings 167, 169 is formed and the o-rings 167, 169 more consistently remain seated in the o-ring glands 166, 168, respectively, during installation and removal of the first and second masking bodies 142, 144.

The first and second masking bodies 142, 144 can be made from various materials, but the material selected should be non-reactive with the chemical solution used for the isotropic superfinish process. It has been determined that PVC with an impact resistance greater than 1.5 ft-lb/in (commonly referred to type II PVC) is a good material to use for the first and second masking bodies 142, 144. PVC type II is non-reactive with the chemicals used in the isotropic superfinish process, has a high impact strength that protects the masking tool from impacts and cracking, and provides sufficient material strength to retain the insert 170. In an exemplary embodiment, a PVC type II with an impact resistance of approximately 10 ft-lb/in is used (PVC type I typically has an impact resistance of 0.65 ft-lb/in or lower). Compared to PVC type II, some other materials, such as ultra-high molecular weight polyethylene (UHMW-PE), do not perform as well. For example, UHMW-PE is nonreactive with the chemical solutions used in the isotropic superfinish process, but lacks the material strength to reliably secure the insert 170 within the endcap 146. Overtime, the UHMW-PE yield and fail where the insert 170 and the endcap 146 join. UHMW-PE also may lack the rigidity that might be needed to maintain a seal.

In some embodiments, the insert 170 is a key-locking insert. It has been determined that, due to the environment in which the masking tool system 140 operates (e.g., exposed to vibratory forces for extend periods of time while experiencing a tensile load from the rod 160), a key-locking insert is able to remain fixed within the endcap 146 to provide a longer service life compared to other types of inserts when used with PVC or PVC type II.

Figure 6:
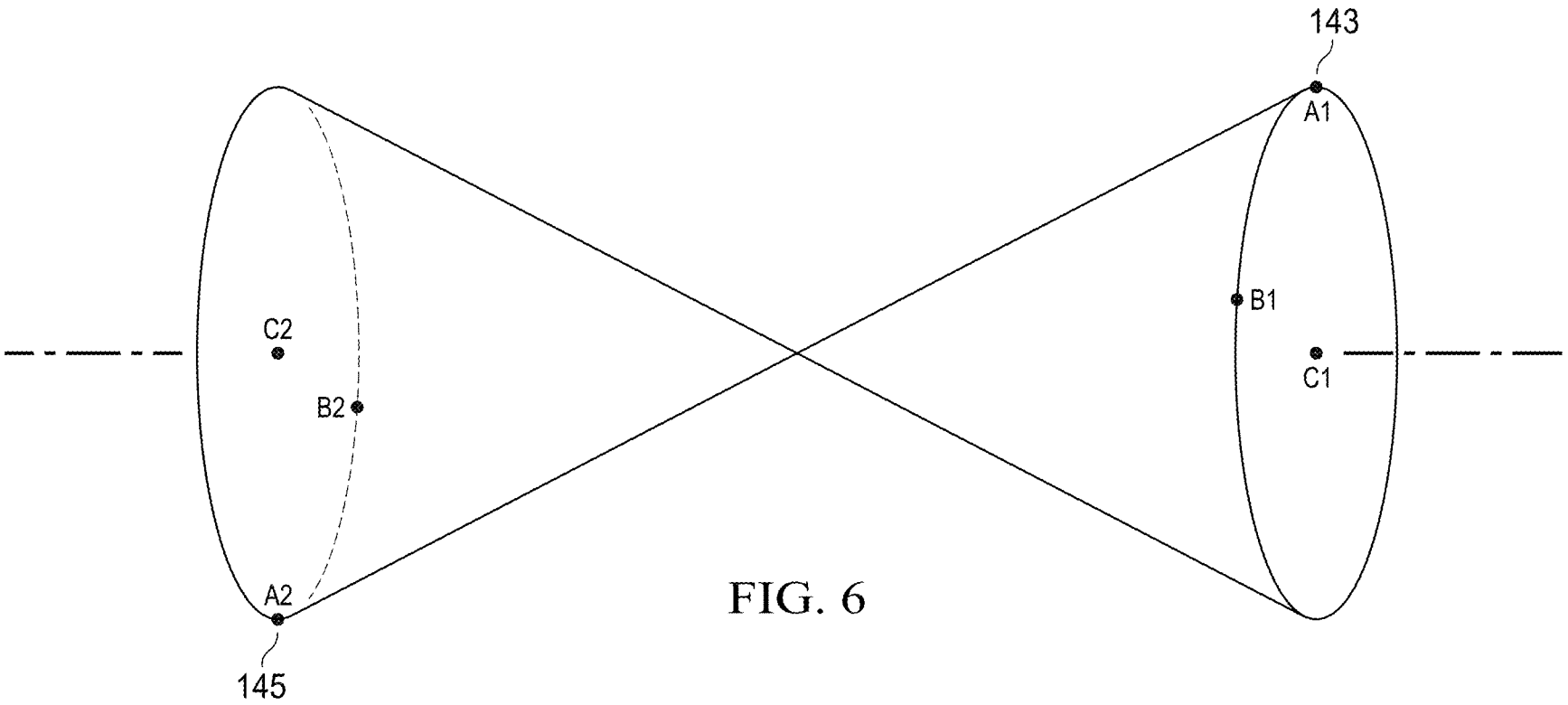
FIG. 6 illustrates a wobbling rotational movement of an exemplary masking tool system.

During processing of the metallic article 120 with the masking tool system 140 secured to the metallic article 120, it has been discovered that, by designing the first and second masking bodies 142, 144 with specific dimensions, a wobbling rotational movement of the masking tool system 140 can be induced. FIG. 6 illustrates the wobbling rotational movement of the masking tool system 140. The wobbling rotational movement somewhat resembles the movement of a kayak paddle. Point A1 represents an end 143 of the first masking body 142 that is distal to the metallic article 120 and point A2 represents an end 145 of the second masking body 144 that is distal to the metallic article 120. During operation of the isotropic superfinish system 100, the masking tool system 140 wobbles such that the end 143 of the first masking body 142 travels from A1 toward B1 and the end 145 of the second masking body 144 travels from A2 toward B2. The end 143 of the first masking body 142 travels in an orbit about point C1 and the end 145 of the second masking body 144 travels in an orbit about point C2. In an exemplary embodiment, the masking tool system 140 also rotates about the central axis 149 as the ends 143, 145 of the masking tool system 140 orbit about points C1 and C2.

In some embodiment, the plurality of holes 114 are positioned on the plurality of baffles 108 to minimize the possibility of the masking tool system 140 contacting the plurality of holes as the masking tool system 140 undergoes the wobbling rotation. For example, the plurality of holes 114 are positioned on the plurality of baffles 108 so that the holes do not coincide with the orbits travelled by the ends of the masking tool system 140.

The wobbling rotational movement of the masking tool system 140 helps ensure that the entire exposed portion of the metallic article 120 is thoroughly exposed to the aggregate 112 and the chemical solution so that the entire exposed portion of the metallic article 120 receives a consistent and high-quality isotropic superfinish treatment. The wobbling rotation also helps to prevent the metallic article 120 from contacting any interior feature of the bowl 102, central portion 110 of the bowl 102, and the plurality of baffles 108. If the metallic article 120 contacts a portion of the bowl 102 or the plurality of baffles 108, the ceramic or plastic components of the aggregate 112 may shatter, which ruins the ceramic or plastic component of the aggregate 112 and can damage the exposed surface of the metallic article 120.

Figure 10:
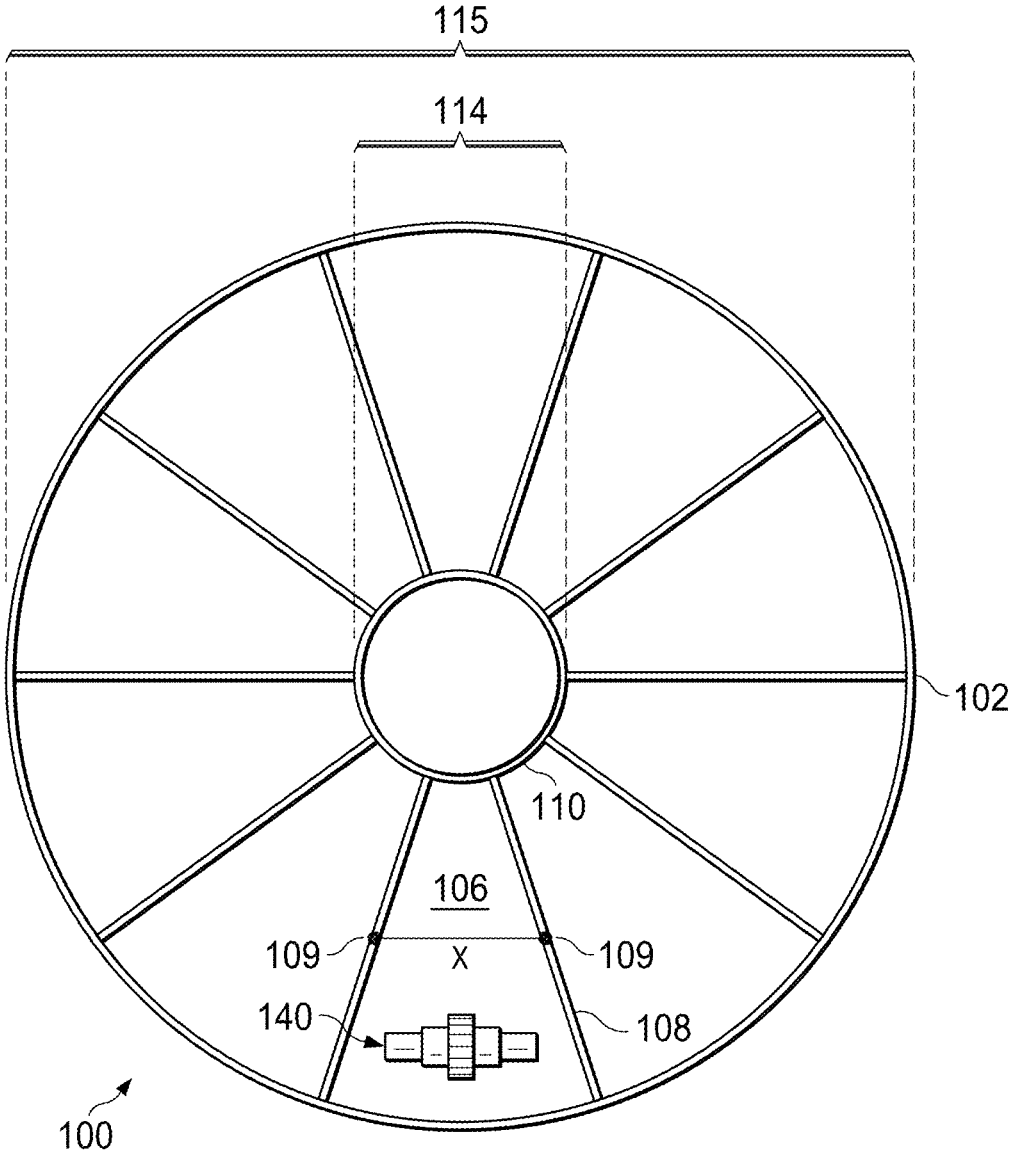
FIG. 10 is a top view of the isotropic superfinish system of FIG. 1 illustrating a midpoint-distance between adjacent baffles.

It has been determined that certain diagonal lengths of the masking tool system 140 induce the wobbling rotational movement. The term "diagonal length" is used to describe a distance between opposite corners of the masking tool system 140. The diagonal length of the masking tool system 140 is used instead of a longitudinal length of the tool because the diagonal length takes into account both a length and a diameter of the masking tool system 140. It has been determined that masking tool systems 140 with longer lengths need to have smaller diameters and masking tool systems 140 with short lengths need to have larger diameters to achieve a desired diagonal length. With regard to FIG. 5, the diagonal length of the masking tool system 140 is the distance between 1 and 2 (shown in FIG. 5 as a dashed line between 1 and 2). In order to cause the wobbling rotational movement, the diagonal length is a value based upon dimensions of pockets 106. In some embodiments, the diagonal length is a value that is greater than a lateral distance (or width) of the pockets 106 as measured between midpoints 109 of the adjacent baffles 108 defining the pocket 106, see e.g. FIG. 10. FIG. 10 is a top view of the isotropic superfinish system 100 illustrating a midpoint-distance X between adjacent baffles 108. The midpoints 109 represent the midpoints of a radial length of baffles 108 from an inner diameter 114 and an outer diameter 115. In some embodiments, the diagonal length has been determined to be approximately 112% of the midpoint-distance X. In some embodiments, the diagonal length has been determined to be between approximately 100.01% and 137.62% of the midpoint-distance X. In typical embodiments, the diagonal length is short enough for the masking tool system 140 to fit within a given pocket 106.

FIG. 10 also illustrates the masking tool system 140 disposed in the pocket 106. In use, the masking tool system 140 is placed into the pocket 106 generally as shown in FIG. 10. As the plurality of baffles 108 begin to rotate and vibration is applied to the bowl 102, the masking tool system 140 begins to move with the wobbling rotation.

By way of particular example, for a 320 liter bowl having an outer diameter of 48.75 inches, an inner diameter of 22.375 inches, and ten baffles, a diagonal length of approximately 11.77 inches (±0.25 inches) has been found to induce the wobbling rotation. For a 620 liter bowl having an outer diameter 60.5 inches, an inner diameter of 26.25 inches, and ten baffles, a diagonal length of approximately 15.5 inches (±0.25 inches) has been found to induce the wobbling rotation. For other bowl dimensions, the diagonal length scales accordingly. The diagonal length for other bowl dimensions can also be found without undue experimentation by observing a particular masking tool system during operation of the isotropic superfinish process. If, during operation of the isotropic superfinish process, the masking tool system does not exhibit the wobbling rotation, the diagonal length of that particular masking tool system can be adjusted. Adjustment of the diagonal length of the masking tool system 140 may be accomplished in various ways. Dimensions of one or more of the endcap 146, the main body 148, and the second masking body 144 may be changed to achieve a desired length.

It has been determined that sizing diameters of the ends of the first and second masking bodies 142, 144 to be larger than diameters of the plurality of holes 114 prevents ends of the first and second masking bodies 142, 144 from becoming lodged or caught in the plurality of holes 114, which would interrupt the wobbling rotational movement. In some embodiments, the plurality of holes 114 may comprise diameters of approximately 2 inches and the ends of the first and second masking bodies 142, 144 have diameters of approximately 2.5 inches.

In some embodiments it may be necessary to tune the frequency of the vibratory force supplied to the bowl 102 for the masking tool system 140 to sustain the wobbling rotational movement. For example, in instances where it is believed that the diagonal length of the masking tool system 140 is correct but the masking tool system 140 does not exhibit the wobbling rotational movement, altering the frequency of the vibratory force up or down may induce the desired movement.

As shown in the FIGS. 4 and 5, the masking tool system 140 includes a single metallic article 120. Other embodiments of the masking tool system 140 may accommodate more than one metallic article 120 (e.g. See FIG. 7) or metallic articles 120 comprising a different shape.

To assemble the masking tool system 140, the rod 160 is attached to the second masking body 144 using the nut 158, a washer 182, a seal 181 (e.g., a rubber washer), a nut 172, and a washer 173. The metallic article 120 may then be slid down the rod 160 so that the side face 124 abuts the o-ring 169 of the second masking body 144. Next, the main body 148 is slid down the rod 160 so that the o-ring 167 abuts the side face 125 of the metallic article 120. The endcap 146 is then threaded onto the rod 160 and tightened so that the o-rings 167, 169, and seal 181 seal an interior of the masking tool system 140 to prevent the chemical solution and aggregate 112 from entering the masking tool system 140. In the embodiment of FIG. 5 the endcap 146 does not include an o-ring gland and relies upon mating of the surfaces between the endcap 146 and the main body 148 to seal the joint therebetween. In other embodiments, either the endcap 146 or the main body 148 may include an o-ring gland and o-ring to provide an o-ring seal. In various embodiments, o-ring glands can be added as desired to add additional seals.

Figure 7:
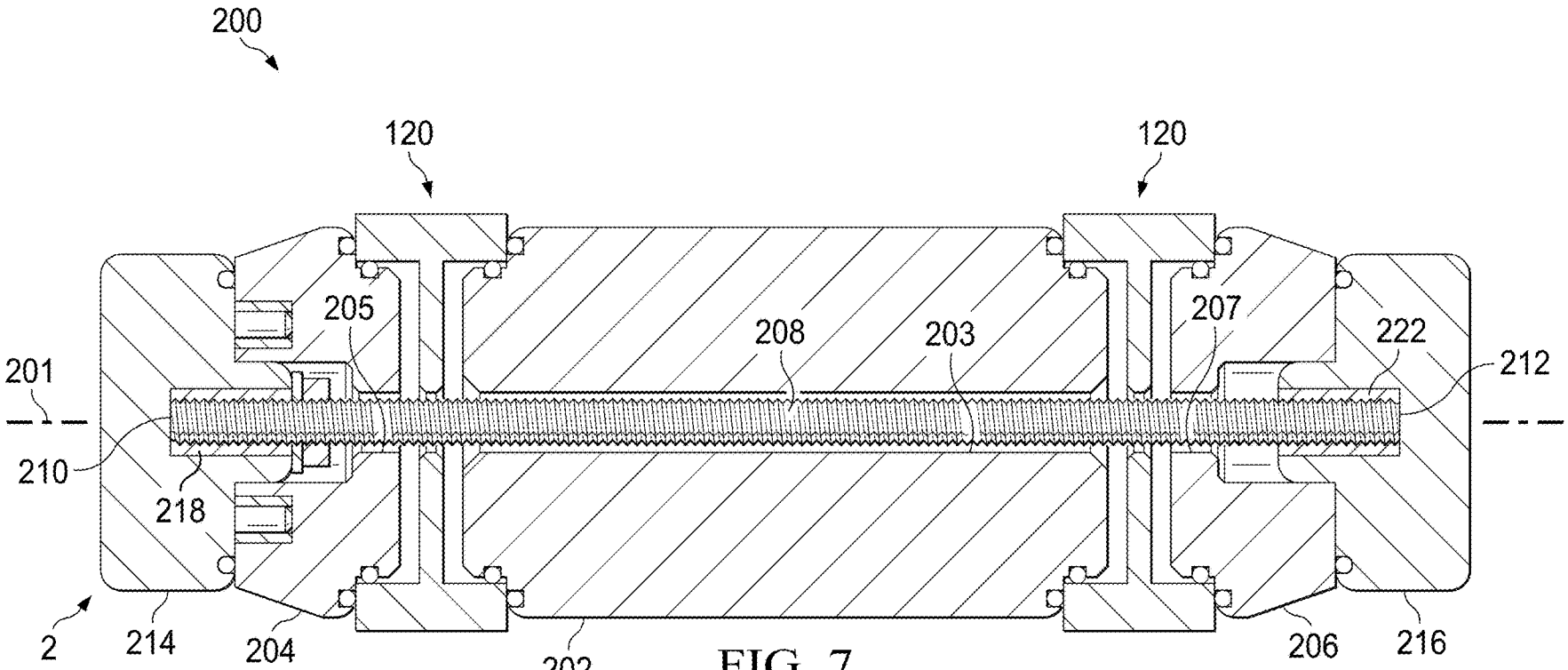
FIG. 7 is a cross-sectional side view of an exemplary masking tool system.

Referring now to FIG. 7, a cross-sectional side view of a masking tool system 200 is shown. The masking tool system 200 comprises a spacer body 202, a first end body 204, and a second end body 206. Each of the spacer body 202 and the first and second end bodies 204, 206 are secured to the metallic articles 120 to mask portions of the metallic articles 120 to prevent the masked portions of the metallic articles 120 from receiving an isotropic superfinish treatment. Each of the spacer body 202 and the first and second end bodies 204, 206 may be made of PVC type II.

The spacer body 202 includes a bore 203, the first end body 204 includes a bore 205, and the second end body 206 includes a bore 207. Each of the bores 203, 205, and 207 are centered about a central axis 201 of the masking tool system 200 and are configured to allow a rod 208 to pass therethrough. In an exemplary embodiment, the rod 208 is an all-thread rod made of heat-treated material for improved strength. In some embodiments, the rod 208 has a diameter of ⅜ths of an inch, which provides improved strength over smaller diameters to resist failures from bending and stripped threads. The rod 208 includes a first rod end 210 configured to attach to a first endcap 214 and a second rod end 212 configured to attach to a second endcap 216. The first rod end 210 attaches to the first endcap 214 by threading into an insert 218 disposed within the first endcap 214. The rod 208 is further secured to the first endcap 214 by a nut 220 and a washer 221. In an exemplary embodiment, the washer 221 is a wedge-lock washer, such as a NORD LOCK® washer. Wedge-lock washers are used because they reduce the risk of the rod 208 backing out of the first endcap 214 due to vibratory forces. The second rod end 212 attaches to the second endcap 216 by threading into an insert 222.

Figure 8:
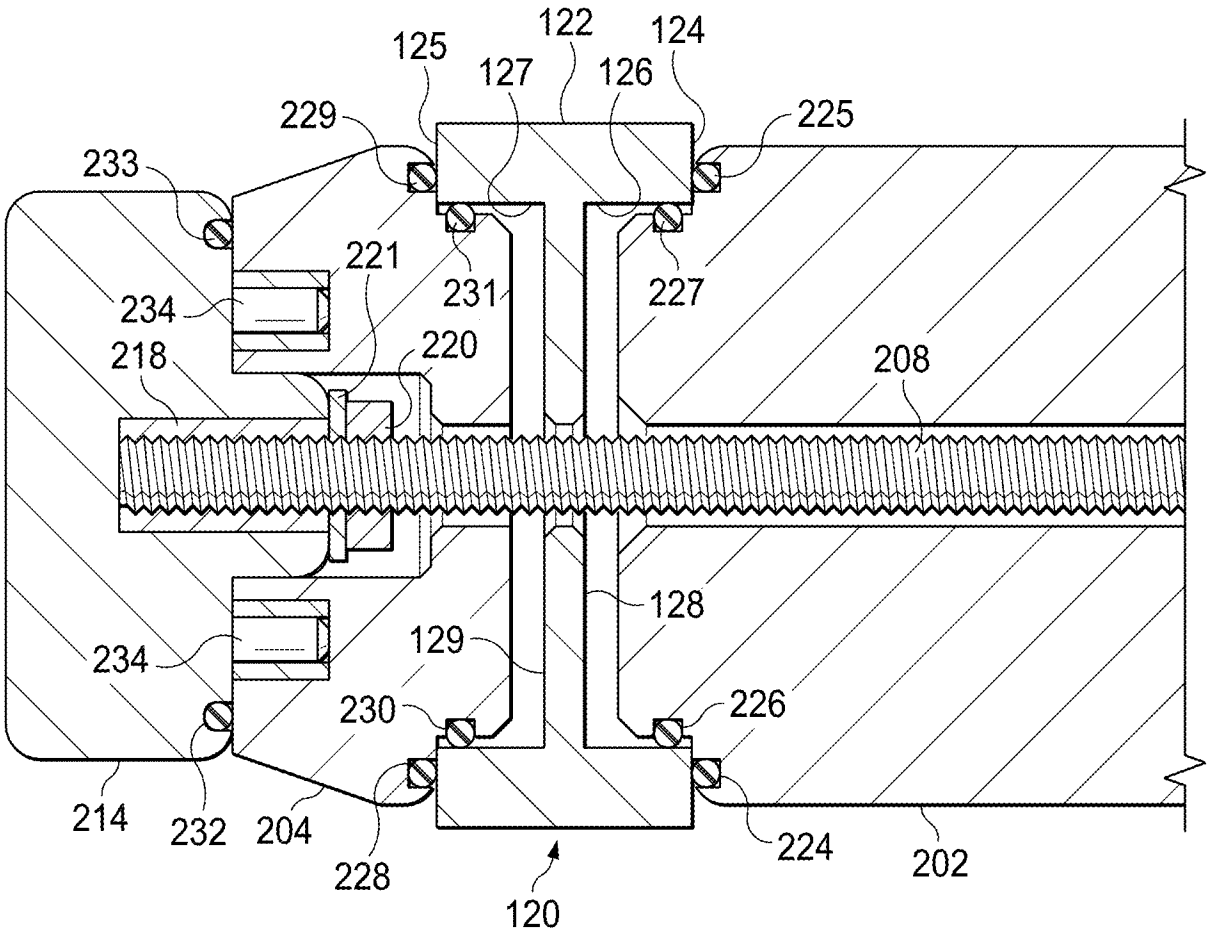
FIG. 8 is a detail cross-sectional view of the masking tool system of FIG. 7.

Referring now to FIG. 8, a detail cross-sectional view of the masking tool system of FIG. 7 is shown. FIG. 8 provides a close-up view of the mating between the first metallic article 120 and the masking tool system 200. To seal the masked portion of the first metallic article 120, the spacer body 202 and first end body 204 include one or more sealing elements, such as o-ring glands and corresponding o-rings, to create seals that prevent the aggregate 112 and the chemical solution from coming into contact with the masked portion of the first metallic article 120. The spacer body 202 includes an o-ring gland 224 and an o-ring gland 226 that include o-rings 225, 227, respectively. The o-ring gland 224 is positioned to create a face seal against side face 124 and the o-ring gland 226 is positioned to protect the inner wall 126 from contacting the spacer body 202 and to radially locate the teeth 122 and the spacer body 202 relative to each other. The first end body 204 includes an o-ring gland 228 and an o-ring gland 230 that include o-rings 229, 231, respectively. The o-ring gland 228 is positioned to create a face seal against side face 125 and the o-ring gland 230 is positioned to protect the inner wall 127 from contacting the first end body 204 and to radially locate the teeth 122 and the first end body 204 relative to each other.

To prevent the aggregate 112 and the chemical solution from entering an interior of the masking tool system 200 at the junction of the first endcap 214 and the first end body 204, the first endcap 214 includes an o-ring gland 232 and an o-ring 233. Each of the o-ring glands 224, 228, and 232 create a face seal and are dimensioned to have a width of about 87% to about 101% of a minimum cross-section of their corresponding o-rings.

To help prevent the first endcap 214 from unscrewing during processing, the first endcap includes pins 234 that prevent rotation of the first endcap 214 relative to the first end body 204. Without the pins 234, unscrewing of the endcap 214 could occur because of the wobbling rotation and vibratory forces that the masking tool system 200 experiences during processing. In other embodiments, different configurations could be used to prevent the first endcap 214 from unscrewing. For example, reverse threads, cotter pins, a key and keyway, interlocking features, and the like could be used.

Figure 9:
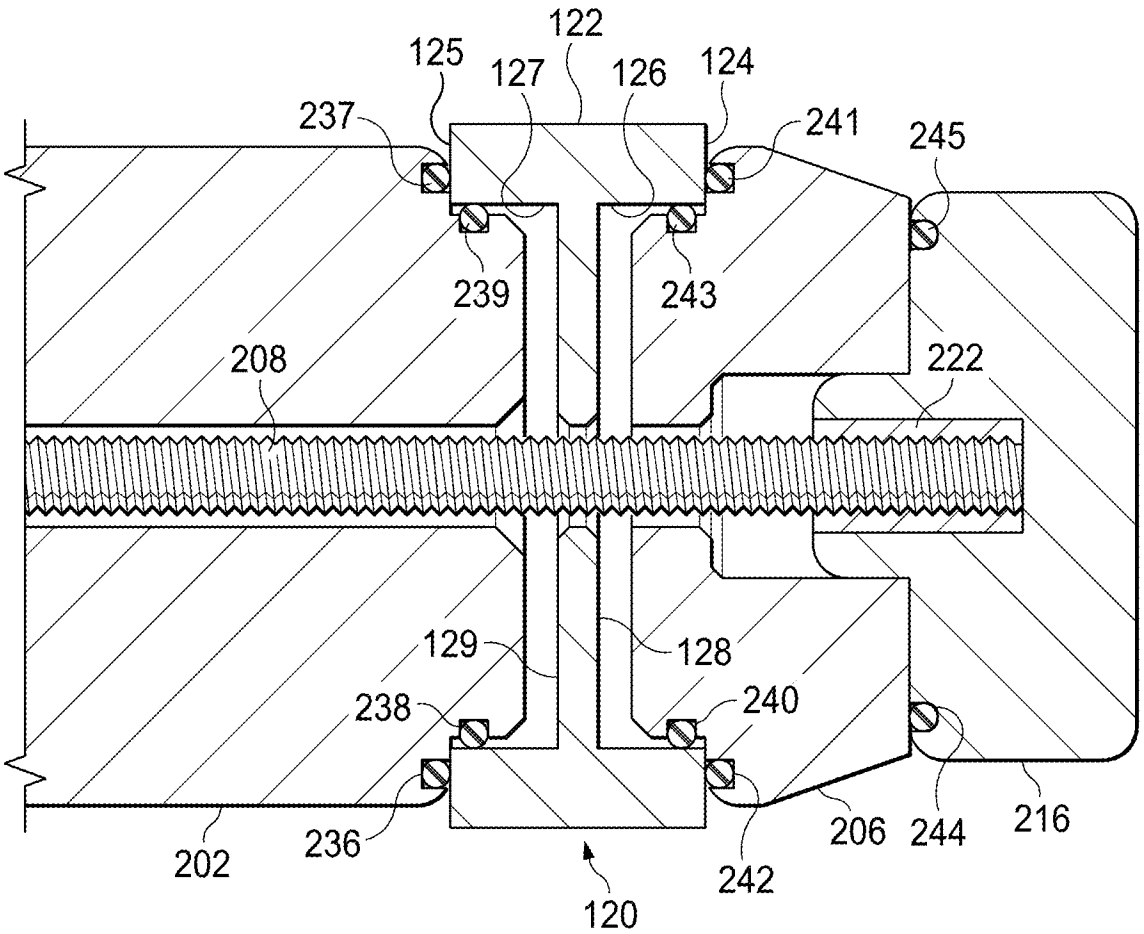
FIG. 9 is a detail cross-sectional view of the masking tool system of FIG. 7.

Referring now to FIG. 9, a detail cross-sectional view of the masking tool system of FIG. 7 is shown. FIG. 9 provides a close-up view of the mating between the second metallic article 120 and the masking tool system 200. To seal the masked portion of the second metallic article 120, the spacer body 202 and second end body 206 include o-ring glands and corresponding o-rings to create seals that prevent the aggregate 112 and the chemical solution from coming into contact with the masked portion of the first metallic article 120. The spacer body 202 includes an o-ring gland 236 and an o-ring gland 238 that include o-rings 237, 239, respectively. The o-ring gland 236 is positioned to create a face seal against side face 125 and the o-ring gland 238 is positioned to protect the inner wall 127 from contacting the spacer body 202 and to radially locate the inner wall 127 and the spacer body 202 relative to each other. The second end body 206 includes an o-ring gland 240 and an o-ring gland 242 that include o-rings 241, 243, respectively. The o-ring gland 240 is positioned to create a face seal against side face 124 and the o-ring gland 242 is positioned to protect the inner wall 126 from contacting the second end body 206 and to radially locate the inner wall 126 and the second end body 206 relative to each other.

To prevent the aggregate 112 and the chemical solution from entering an interior of the masking tool system 200 at the junction of the second endcap 216 and the second end body 206, the second endcap 216 includes an o-ring gland 244 and an o-ring 245. Each of the o-ring glands 236, 240, and 244 create face seals and are dimensioned to have a width of about 87% of a maximum cross-section and 101% of a minimum cross-section of their corresponding o-rings.

The second endcap 216 attaches to the rod 208 by threading the rod 208 into an insert 222. Tightening the endcap 216 compresses components of the masking tool system 200 together to seal an interior of the masking tool system 200.

To assemble the masking tool system 200, the rod 208 is attached to the first endcap 214 by threading the rod 208 into the insert 218. The nut 220 and the washer 221 are then fastened against the first endcap 214 as shown in FIG. 7 to lock the rod 208 in place. The first end body 204 is then slid onto the rod 208 so that it abuts the first endcap 214. A first metallic article 120, illustrated in FIG. 7 as a gear, is slid onto the rod 208 followed by the spacer body 202. A second metallic article 120, also illustrated as a gear, is slid onto the rod 208 followed by the second end body 206. Finally the second endcap 216 is attached to the rod 208 by threading the rod 208 into the insert 222.

With regard to FIG. 7, the diagonal length of the masking tool system 200 is the distance between opposing diagonal end points 1 and 2. In order to cause the wobbling rotational movement, the diagonal length is a value based upon dimensions of the pocket 106. In some embodiments, the diagonal length is a value that is greater than a distance between midpoints of adjacent baffles 108. FIG. 10 is a top view of the isotropic superfinish system 100 illustrating a midpoint-distance X between adjacent baffles 108.

By way of particular example, for a 320 liter bowl having an outer diameter of 48.75 inches, an inner diameter of 22.375 inches, and ten baffles, a diagonal length of approximately 11.77 inches (±0.25 inches) has been found to induce the wobbling rotation. For a 620 liter bowl having an diameter of 60.5 inches, an inner diameter of 26.25 inches, and ten baffles, a diagonal length of approximately 15.5 inches (±0.25 inches) has been found to induce the wobbling rotation. For other bowl dimensions, the diagonal length scales accordingly. The diagonal length for other bowl dimensions can also be found without undue experimentation by observing a particular masking tool system during operation of the isotropic superfinish process. If, during operation of the process, the masking tool system does not exhibit the wobbling rotation, the diagonal length of that particular masking tool system can be adjusted. Adjustment of the diagonal length of the masking tool system 200 may be accomplished by swapping out the first and second endcaps 214, 216 for endcaps comprising different lengths. For example, the masking tool system 200 may include a plurality of first and second endcaps 214, 216 comprising a variety of endcap lengths. The first and second end bodies 204, 206 include standardized features to permit different first and second endcaps 214, 216 to be swapped out as needed. This standardization provides for easy adjustments to be made to the masking tool system 200 to be made in order to ensure that the masking tool system 200 experiences the wobbling rotation during processing in the isotropic superfinish system 100.

As shown in FIG. 7, the masking tool system 200 is configured to mask two metallic articles 120. In other embodiments, the masking tool system 200 may be configured to mask a single metallic article 120. In such an embodiment, the spacer body 202 could be removed from the masking tool system 200 and the first and second end bodies 204, 206 would be positioned on opposite sides of the single metallic article 120. In order to achieve a desired diagonal length, longer first and second endcaps 214, 216 may be used. In lieu of removing the second metallic article 120, a spacer or blank having a similar size as the second metallic article 120 may be substituted for the second metallic article 120. In such a case, the spacer body 202 is still used.

In an exemplary embodiment, diameters of the first and second endcaps 214, 216 are sized so that they are larger than diameters of the plurality of holes 114. This relationship prevents the first and second endcaps 214, 216 from becoming lodged or caught in the plurality of holes 114, which would interrupt the wobbling rotational movement. In some embodiments, the plurality of holes 114 may comprise diameters of approximately 2 inches and the first and second endcaps 214, 216 have diameters of approximately 2.7 inches. In some embodiments, the first and second endcaps 214, 216 have diameters of approximately 3.5 inches for larger metallic articles 120 that require a bigger masking area.

In various embodiments of the masking tool system 140 and the masking tool system 200, one or more components may be color coded to indicate how the systems 140, 200 should be placed into a pocket 106. For example one or both ends of the systems 140, 200 may be colored. In some embodiments, faces of the plurality of baffles 108 may be color coded to correspond with the ends of the systems 140, 200. Proper placement of the systems 140, 200 within a pocket can help prevent portions of the systems 140, 200 from unscrewing, which would allow the chemical solution to seep into the tool. For example, it has been observed that if the masking tool system 140 is placed into the bowl 102 with the first masking body 142 on a trailing side of a pocket when the plurality of baffles 108 are stirring in a counter-clock wise direction, the endcap 146 may slowly unscrew. To avoid this, the endcap 146 is oriented so that it is on the lead side of the pocket. Color coding the endcap 146 and/or the faces of the plurality of baffles 108 helps a user place the masking tool system 140 into the bowl 102 with the correct orientation. A similar system may be used with the masking tool system 200.

Figure 11:
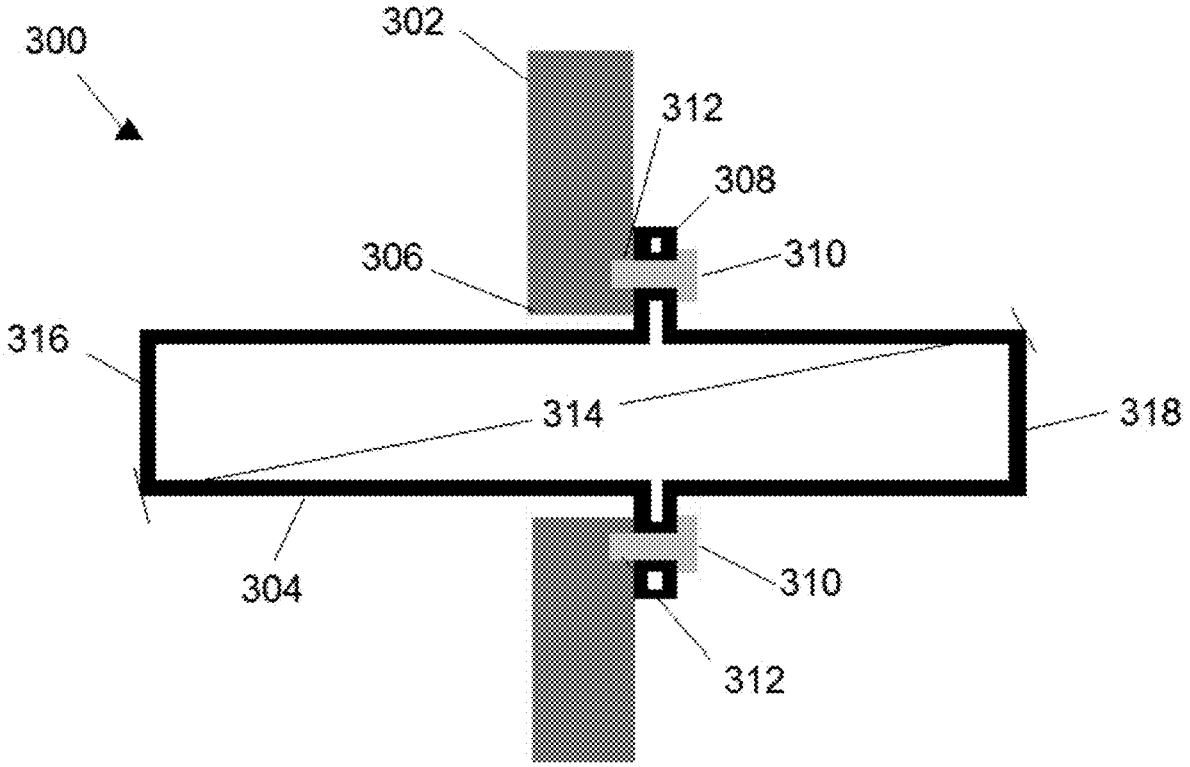
FIG. 11 is a cross-sectional side view of an exemplary masking tool system.

Referring now to FIG. 11, a cross-sectional side view of an exemplary masking tool system 300 is shown affixed to a metallic article 302. By way of example, FIG. 11 illustrates the metallic article 302 in the form of a gear. In various embodiments, the metallic article 302 may comprise one or more of a gear, spline, crankshaft, camshaft, bearing, bearing surface, coupling, shaft, and journal. Dimensions and form of the metallic article 302 may vary. The masking tool system 300 differs, in part, from the masking tool systems 140 and 200 in that the masking tool system 300 does not include a rod that passes through the masking tool system 300. Instead, the masking tool system 300 includes a body 304 that passes through an opening 306 of the metallic article 302. The body 304 may be a solid piece or may be hollow. In an exemplary embodiment, the body 302 is made of PVC type II, similar to the first masking body 142. As shown in FIG. 11, the body 304 is a unitary piece that includes a flange 308 that extends away from the body 304. In other embodiments, the body 304 may comprise multiple pieces that are secured to one another. In an exemplary embodiment, the body 304 and the flange 308 have circular cross-sections. In other embodiments, the body 304 and the flange 308 may have a different cross-section such as rectangular, triangular, polygonal, etc.

The body 304 attaches to the metallic article 302 via fasteners 310. The fasteners 310 interact with features 312 of the metallic article 302 to secure the body 304 to the metallic article 302. For example, the fasteners 310 may comprise bolts and the features 312 may comprise threaded bores. In other embodiments, the features 312 may comprise an unthreaded bore and the fasteners 310 may comprise pegs or pins. In some embodiments, the flange 308 may include one or more seals, such as o-ring glands, to create a face seal to seal a portion of the metallic article 302 to create a mask that prevents the sealed portion(s) of the metallic article 302 from contacting the chemical solution and/or aggregate 112. In some embodiments, the body 304 may include one or more seals, such as o-ring glands, to create radial seals between the body 304 and a radial face of the opening 306. The o-ring glands may be similar to the o-ring glands discussed above relative to the masking tool systems 140 and 200.

A diagonal length 314 of the masking tool system 300 may be dimensioned similar to the diagonal lengths discussed above relative to the masking tool systems 140 and 200. In an exemplary embodiment, ends 316 and 318 of the body 304 comprise diameters that are larger than holes 114 of the baffles 108.

Figure 12:
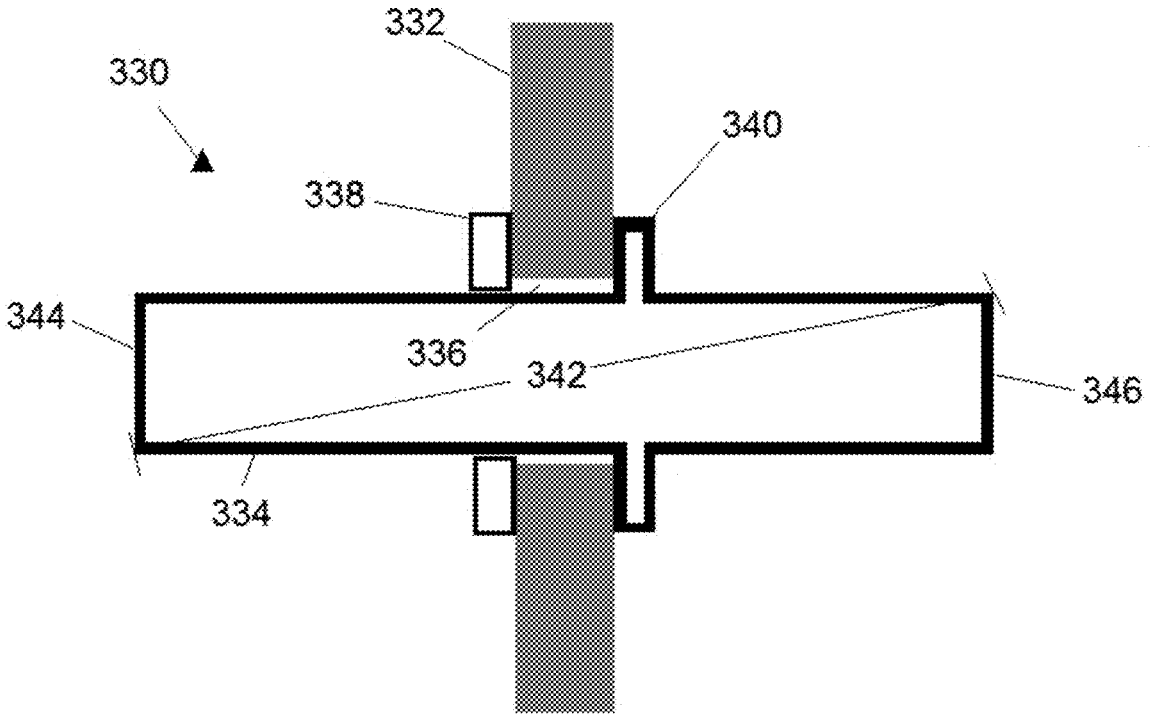
FIG. 12 is a cross-sectional side view of an exemplary masking tool system.

Referring now to FIG. 12, a cross-sectional side view of an exemplary masking tool system 330 is shown affixed to a metallic article 332. By way of example, FIG. 12 illustrates the metallic article 332 in the form of a gear. In various embodiments, the metallic article 332 may comprise one or more of a gear, spline, crankshaft, camshaft, bearing, bearing surface, coupling, shaft, and journal. Dimensions and form of the metallic article 332 may vary. The masking tool system 330 differs, in part, from the masking tool systems 140 and 200 in that the masking tool system 330 does not include a rod that passes through the masking tool system 330. Instead, the masking tool system 330 includes a first body 334 that passes through an opening 336 of the metallic article 332. The masking tool system 330 is secured to the metallic article 332 by securing a second body 338 to the first body 334. As shown in FIG. 12, the second body 338 is in the shape of a ring. In an exemplary embodiment, the second body 338 may thread onto the first body 334 to securely fasten the masking tool system 330 to the metallic article 332. In some embodiments, the second body 338 may be force-fit onto the first body 334 and pressed against the metallic article 332. In some embodiments, the second body 338 is secured to the metallic article 332 via fasteners, similar to how the body 304 is secured to the metallic article 302.

As shown in FIG. 12, the first body 334 is a unitary piece that includes a flange 340 that extends away from the first body 334. In other embodiments, the first body 334 may comprise multiple pieces that are secured to one another. In an exemplary embodiment, the first body 334, the second body 338, and the flange 340 have circular cross-sections. In other embodiments, the first body 334, the second body 338, and the flange 340 may have different cross-sections such as rectangular, triangular, polygonal, etc. In some embodiments, the flange 340 and the second body 338 may include one or more seals, such as o-ring glands, to create face seals to seal a desired portion of the metallic article 332 to create a mask that prevents the sealed portion of the metallic article 332 from contacting the aggregate 112. The o-ring glands may be similar to the o-ring glands discussed above relative to the masking tool systems 140 and 200. The first body 334 and second body 338 may also include radial seals that seal against a radial face of the opening 336 to create a mask that prevents the sealed portion(s) of the metallic article 332 from contacting the chemical solution and/or the aggregate 112.

A diagonal length 342 of the masking tool system 330 may be dimensioned similar to the diagonal lengths discussed above relative to the masking tool systems 140 and 200. In an exemplary embodiment, ends 344 and 346 of the first body 334 comprise diameters that are larger than holes 114 of the baffles 108.

Figure 13:
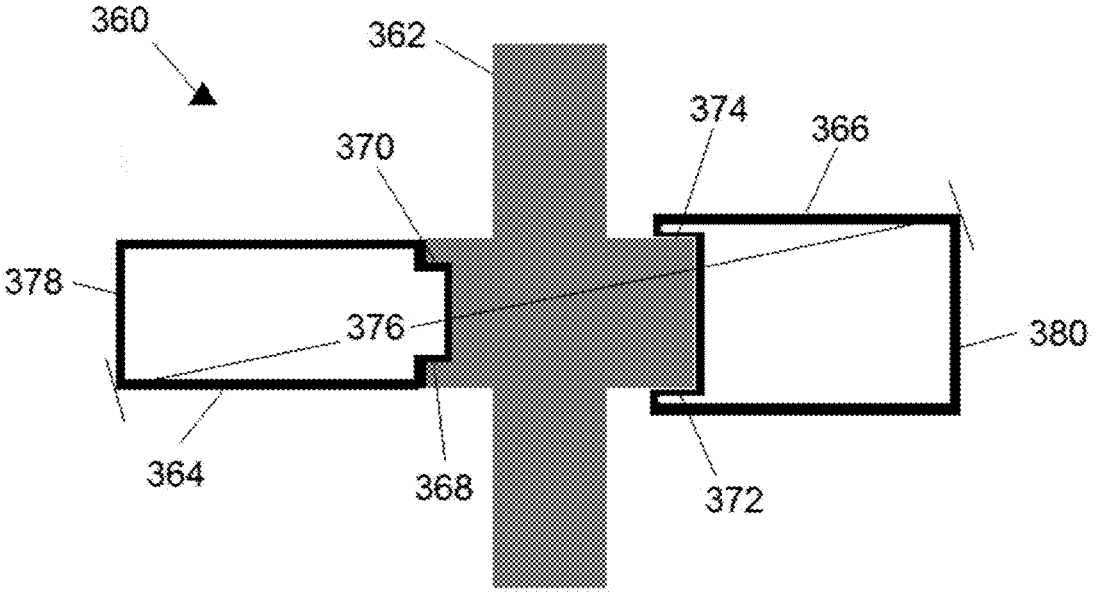
FIG. 13 is a cross-sectional side view of an exemplary masking tool system.

Referring now to FIG. 13, a cross-sectional side view of an exemplary masking tool system 360 is shown affixed to a metallic article 362. By way of example, FIG. 13 illustrates the metallic article 362 in the form of a gear. In various embodiments, the metallic article 362 may comprise one or more of a gear, spline, crankshaft, camshaft, bearing, bearing surface, coupling, shaft, and journal. Dimensions and form of the metallic article 362 may vary. The metallic article 362 does not include an opening or bore that passes through the metallic article 362. The masking tool system 360 differs, in part, from the masking tool systems 140 and 200 in that the masking tool system 360 does not include a rod that passes through the masking tool system 360. Instead, the masking tool system 360 includes a first body 364 and a second body 366, each of which affix to the metallic article 362 by coupling to a feature of the metallic article 362. For example, the first body 364 couples to the metallic article 362 via a plug portion 368 that fits into a recess 370 of the metallic article 362. The second body 366 couples to the metallic article 362 by threadably attaching a threaded portion 372 of the second body 366 to a threaded portion 374 of the metallic article 362. In an exemplary embodiment, the recess 370 and the threaded portion 374 of the metallic article 362 are features of the metallic article 362 that exist for the end-use of the metallic article 362. For example, the metallic article 362 may be a gear that is threaded to another component by the threaded portion 372. In general, the first and second bodies 364, 366 are designed to include features and dimensions that allow the first and second bodies 364, 366 to couple to existing features of the metallic article 362.

As shown in FIG. 13, the first and second bodies 364, 366 are unitary pieces. In other embodiments, the first and second bodies 364, 366 may comprise multiple pieces that are secured to one another to form the first and second bodies 364, 366, respectively. In an exemplary embodiment, the first and second bodies 364, 366 have circular cross-sections. In other embodiments, the first and second bodies 364, 366 may have different cross-sections such as rectangular, triangular, polygonal, etc. In some embodiments, the first and second bodies 364, 366 may include one or more seals, such as o-ring glands, to create face seals and/or radial seals to seal a desired portion or portions of the metallic article 362 to create a mask that prevents the sealed portion(s) of the metallic article 362 from contacting chemical solution and/or the aggregate 112. The o-ring glands may be similar to the o-ring glands discussed above relative to the masking tool systems 140 and 200.

A diagonal length 376 of the masking tool system 360 may be dimensioned similar to the diagonal lengths discussed above relative to the masking tool systems 140 and 200. In an exemplary embodiment, ends 378 and 380 of the masking tool system 360 comprise diameters that are larger than holes 114 of the baffles 108.

Each of the embodiments shown in FIGS. 11, 12, and 13 may be adapted to include various features of the embodiments discussed relative to FIGS. 4, 5, and 7-9. For example, the embodiments of FIGS. 11, 12, and 13 may be adapted to include endcaps similar to the endcaps 214, 216 of FIGS. 7, 8, and 9.

The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," "generally," and "about" may be substituted with "within [a percentage] of" what is specified, as understood by a person of ordinary skill in the art.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A method of applying an isotropic superfinish to a portion of a metallic article, the method comprising:

masking a portion of the metallic article with a masking tool system, the masking tool system comprising a diagonal length;

placing the masking tool system into a pocket defined by adjacent baffles within a bowl of an isotropic superfinish system, each of the adjacent baffles comprising a midpoint along a radial length thereof, a distance between the midpoints defining a midpoint distance between the adjacent baffles; and wherein the diagonal length is greater than the midpoint distance between the adjacent baffles.

2. The method of claim 1, wherein the masking tool system moves within the pocket with a wobbling rotational movement during processing of the metallic article by the isotropic superfinish system.

3. The method of claim 1, wherein the masking tool system comprises:

a first masking body comprising:

a bore passing through a portion of the first masking body; and a first sealing element disposed on a first end of the first masking body;

a second masking body comprising:

a bore passing through the second masking body; and a second sealing element disposed on a first end of the second masking body; and a rod passing through the bores of the first and second masking bodies and to secure the first and second masking bodies to a metallic article placed therebetween.

4. The method of claim 1, wherein the masking tool system comprises:

a first end body comprising:

a bore passing through the first end body; and a first sealing element disposed on a first end of the first end body;

a second end body comprising:

a bore passing through the second end body; and a second sealing element disposed on a first end of the second end body;

a first endcap coupling to the first end body and comprising a third sealing element providing a seal between the first endcap and the first end body;

a second endcap coupling to the second end body and comprising a fourth sealing element providing a seal between the second endcap the second end body; and a rod passing through the bores of the first and second end bodies and to secure the first and second end bodies to a metallic article placed therebetween.

5. The method of claim 3, wherein the first masking body further comprises:

a main body on which the first sealing element is disposed;

an endcap coupling to the main body that threadably attaches to the rod; and the bore passing through the portion of the first masking body passing completely through the main body and not passing completely through the endcap.

6. The method of claim 3, the second masking body comprising a recessed bore housing a nut such that the nut is recessed from an end of the second masking body when the nut is secured to the rod.

7. The method of claim 6, comprising securing, by a wedge-lock washer and a nut disposed on the rod, of the rod to the second masking body.

8. The method of claim 4, wherein each of the first sealing element and the second sealing element each comprise o-ring glands with o-rings.

9. The method of claim 8, wherein a width of each o-ring gland is between about 87% to about 101% of a cross-section of each o-ring gland's corresponding o-ring.

10. The method of claim 3, wherein diameters of ends of the first masking body and the second masking body are larger than a diameter of a hole in a baffle used in an isotropic superfinish system with which the masking tool system is used.

11. The method of claim 4, further comprising:

a spacer body configured to be position between the first end body and the second end body; and wherein the masking tool system is configured to secure a first metallic article between the first end body and a first side of the spacer body and a second metallic article between the second end body and a second side of the spacer body.

12. The method of claim 4, wherein each of the first sealing element, the second sealing element, the third sealing element, and the fourth sealing element comprises an o-ring gland and an o-ring.

13. The method of claim 4, wherein each of the first sealing element, the second sealing element, the third sealing element, and the fourth sealing element seals off a masked portion of the metallic article to prevent the masked portion from coming into contact with a chemical solution.

14. The method of claim 3, wherein a width of each o-ring gland is between about 87% to about 101% of a cross-section of each o-ring gland's corresponding o-ring.

15. The method of claim 4, further comprising a pin that extends from the first endcap into the first end body to prevent rotation of the first endcap relative to the first end body.

16. The method of claim 4, wherein diameters of ends of the first and second endcaps are larger than a diameter of a hole in a baffle used in an isotropic superfinish system with which the masking tool system is used.

* * * * *